US007128235B2

(12) United States Patent
Haddad et al.

(10) Patent No.: US 7,128,235 B2
(45) Date of Patent: Oct. 31, 2006

(54) BATHROOM CADDY FOR DISPOSABLE WET WIPES

(76) Inventors: Philip Laracy Haddad, 105 Penwood Rd., Basking Ridge, NJ (US) 07922; Joseph Francis Haddad, 29 Sunset Pl., Millington, NJ (US) 07946

( * ) Notice: Subject to any disclaimer, the term of this patent is extended or adjusted under 35 U.S.C. 154(b) by 297 days.

(21) Appl. No.: 10/873,438

(22) Filed: Jun. 23, 2004

(65) Prior Publication Data

US 2005/0284881 A1 Dec. 29, 2005

(51) Int. Cl.
*B65H 1/00* (2006.01)

(52) U.S. Cl. ..... 221/45; 221/46; 221/199; 221/283

(58) Field of Classification Search ..... 221/45, 221/46, 63, 283, 199; 248/207, 214, 215, 248/339, 340; 242/588.3, 588.4, 588.6
See application file for complete search history.

(56) References Cited

U.S. PATENT DOCUMENTS

| | | | | |
|---|---|---|---|---|
| 2,122,048 | A * | 6/1938 | Shapiro | 206/494 |
| 2,685,365 | A * | 8/1954 | Sieven | 206/410 |
| 2,790,608 | A | 4/1957 | Sieven | |
| 3,837,595 | A * | 9/1974 | Boone | 242/594.5 |
| 4,004,687 | A * | 1/1977 | Boone | 206/233 |
| 4,106,616 | A | 8/1978 | Boone | |
| 4,235,333 | A | 11/1980 | Boone | |
| 4,638,921 | A * | 1/1987 | Sigl et al. | 221/1 |
| 4,978,095 | A | 12/1990 | Phillips | |
| 5,192,044 | A | 3/1993 | Baskin | |
| 5,348,168 | A | 9/1994 | Emery | |
| 6,241,388 | B1 | 6/2001 | Terramani | |
| 6,382,552 | B1 | 5/2002 | Paul | |
| 6,540,195 | B1 | 4/2003 | Newman | |
| 6,546,572 | B1 | 4/2003 | Demonet | |
| 6,568,625 | B1 | 5/2003 | Faulks | |
| 6,581,790 | B1 | 6/2003 | Zadro | |
| 6,929,148 | B1 * | 8/2005 | Haddad et al. | 221/45 |

* cited by examiner

*Primary Examiner*—David H. Bollinger

(57) ABSTRACT

A dual arm caddy to be attached to the spindle of a wall mounted toilet paper holder for carrying disposable wet wipes. The upper portion of each arm is attached by hooking the spindle, and the lower, utility portion is attached to a container inclined from front to rear. A lid is rear-hinged. The hooking means can be a U-shaped slot open in the rear of the arm's upper portion, and inclined upward and elongated to assure the caddy makes wall contact before engaged spindle reaches slot's upper end. Embodiments include caddies suspendable from crossbars such as towel racks to provide consistently horizontal and stable utility platforms throughout a range of crossbar-to-wall distances. The hooking means of the arms can also be rounded to allow them to freely rest on top of the crossbar and the caddy configured to always occupy the space closest to the wall to which the crossbar is attached.

5 Claims, 5 Drawing Sheets

BATHROOM CADDY FOR DISPOSABLE WET WIPES

BACKGROUND OF THE INVENTION

Disposable wet wipes have increasing use as a supplement to toilet paper. The objective of the primary embodiment of this invention is to make the wipes as conveniently available to the user as toilet paper now is. This objective is achievable by a caddy that shares the spindle of a wall mounted toilet paper holder, provided the caddy does not interfere with toilet paper use, occupies a minimal amount of space, and possesses good storage and accessibility features. These characteristics are attained by a low profile caddy that rests snugly and vertically against the wall for stability and space conservation regardless of spindle-to-wall distance.

Spindle-to-wall distances vary. Wall mounted holders are either recessed in the wall or attached to the surface of the wall. The spindle-to-wall distance of surface mounted holders is slightly more than 2.5 inches, the radius of a full roll of paper. With recessed holders the spindle itself can be nearly flush with the wall. Thus a commercially valuable caddy should rest vertically against the wall throughout approximately a 2.5 inch range of spindle-to-wall distances.

We believe caddies of our invention have the above characteristics and meet the stated objective.

SUMMARY OF THE INVENTION

The primary embodiment of this invention is a dual arm caddy for disposable wet wipes. The upper portion of each arm is hook-shaped and attachable to the spindle of a wall mounted toilet paper holder and the lower portion of the arms form brackets to which is attached a container for storing the wipes. For space conservation and ease of access the container is inclined from front to rear. A lid for moisture retention is rear hinged.

A feature of this invention is a means of engaging a spindle or other wall mounted crossbar, such as a towel rack, that allows the caddy to rest vertically against the wall throughout a range of crossbar-to-wall distances. The upper portion of each arm is a hook formed as a U-shaped slot that opens in the rear and is inclined upward and is sufficiently elongated to assure the caddy will make contact with the wall before the engaged crossbar reaches the upper end of the slot.

The primary embodiment of this invention includes an alternative configuration for applications where the crossbar-to-wall distance is fixed or where crossbar-to-wall distance is not fixed and the container inclination angle can vary over a range of various cross bar-to-wall distances, and the container's front to back diagonal is not greater than twice the crossbar-to-wall distance. The hook portion of the arms is curved to allow the caddy arms to freely rest on the crossbar, permitting the apex of the crossbar to act as a fulcrum. The arms and container are configured to stabilize the caddy against the wall with minimal protrusion of the container beyond the crossbar. As will be fully described below and shown in the drawings, for a fixed maximum crossbar-to-wall distance, the arms are contoured and sized, the container-to-arm attachment angle determined, and the container weighted as needed so that the caddy will be inclined at the proper angle and in contact with the wall regardless of container content. The features of this configuration can be applied to other caddy configurations where the utility platform consists of shelving rather than a container and where the crossbar-to-wall distance is fixed.

Other embodiments using this invention's U shaped slot attachment means are caddies that can be suspended from towel racks or other wall mounted crossbars to provide consistently horizontal and stable utility platforms for various purposes throughout a range of crossbar-to wall distances.

The drawings of this invention's primary embodiment, described below, illustrate the unique features of all embodiments.

Figure 1:
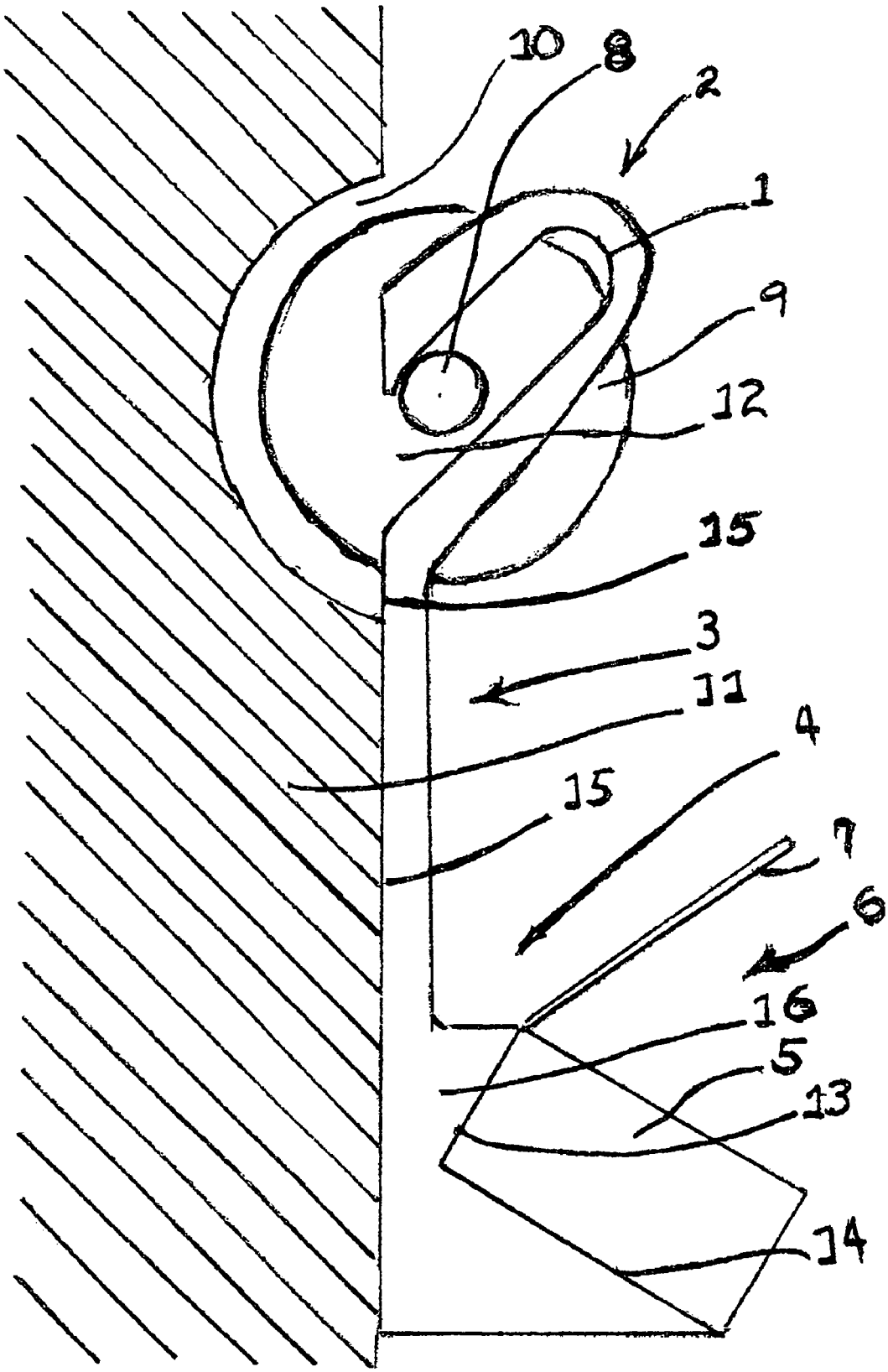
FIG. 1 is a side view of a caddy of this invention attached to spindle 8 of a toilet paper holder that is recessed 10 in a wall 11. Arm 3 has a mounting portion 2 at the upper end and a utility portion 4 at the lower end. The mounting portion is a hook formed as a U-shaped slot 1 with an opening 12 in the rear surface 15 of arm 3 mounting portion 2. Slot 1 inclines upward from opening 12 and traverses a lateral distance at least equivalent to the radius of a full roll of toilet paper 9. Spindle 8 is at the lower end of slot 1 retained by lip 17 which is aligned with the rear surface 15 of arm 3 which rests flush against wall 11. The forward facing surface 16 of utility portion 4 of arm 3 is attached to the back side 13 and bottom 14 of container 6. Hinged lid 7 is shown open.
Figure 2:
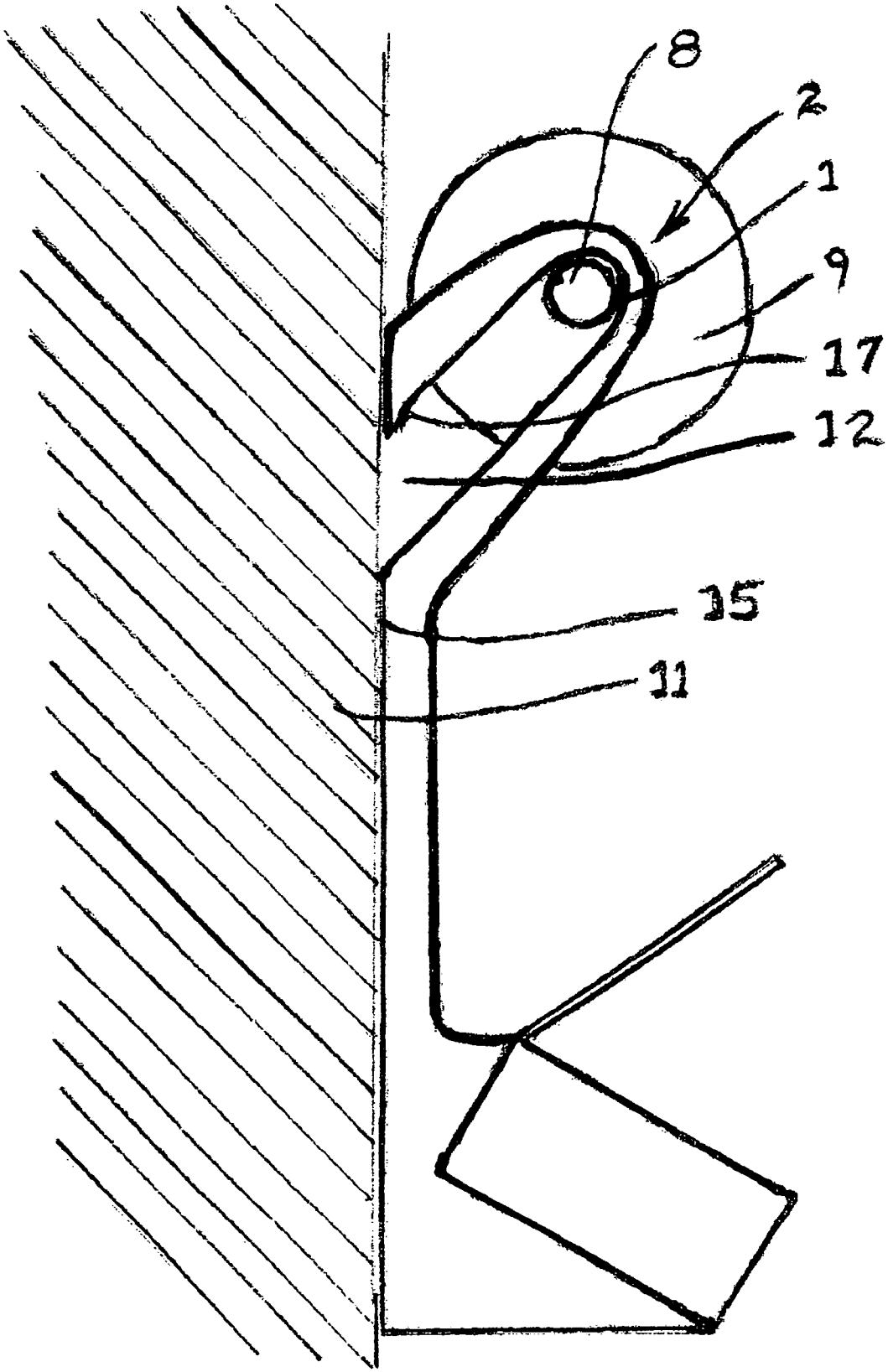
FIG. 2 shows a side view of the FIG. 1 caddy, however it is attached to the spindle 8 of a wall mounted toilet paper holder. The spindle-to-wall distance is slightly greater than the radius of the full roll of toilet paper 9. Spindle 8 is now located at the upper end of slot 1. The entire rear surface 15 of arm 3, including the lip 17 of opening 12 of slot 1, rests flush against wall 11.
Figure 3:
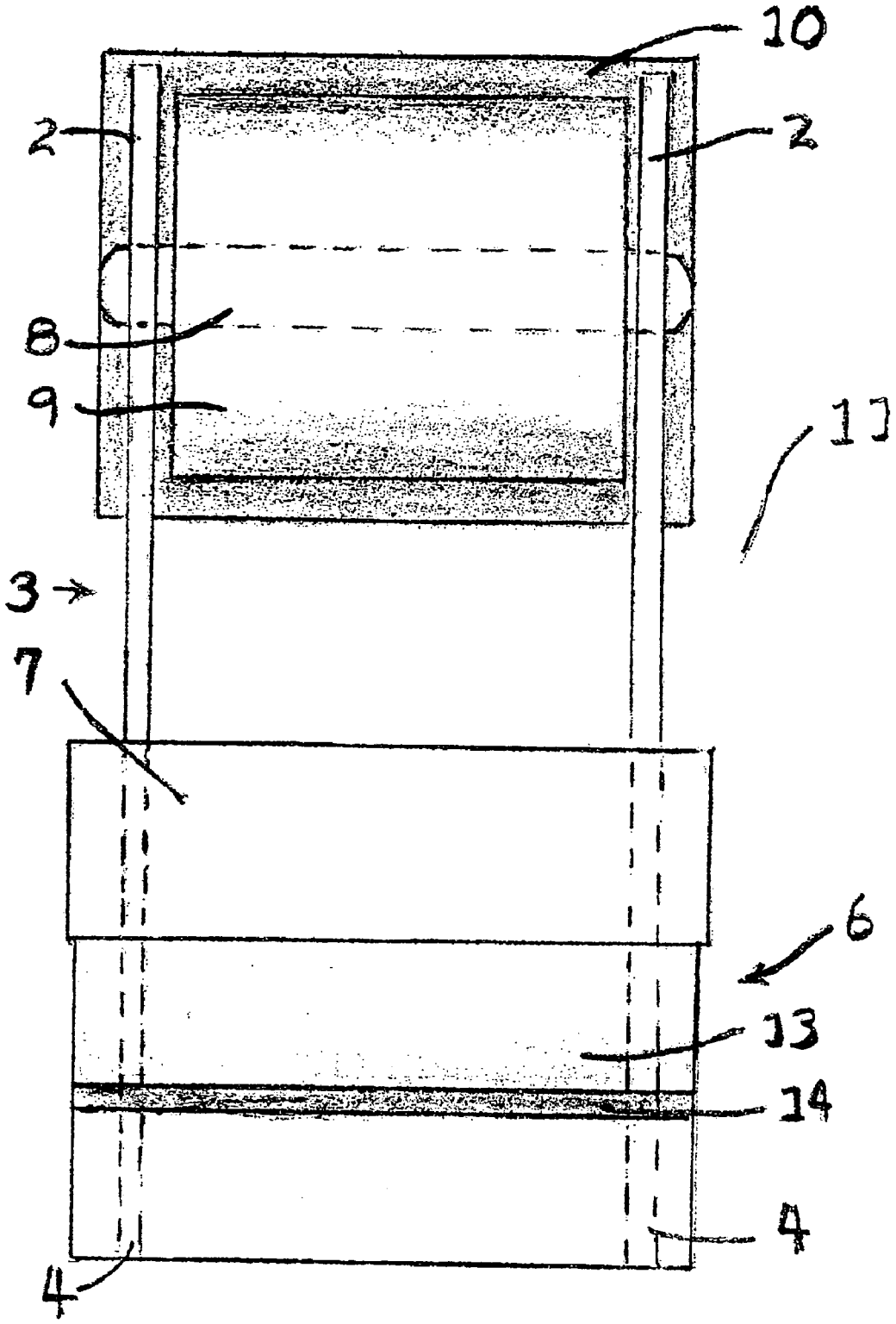
FIG. 3 is a front view of the caddy attached to spindle 8 of a holder that is recessed 10 in wall 11, as in FIG. 1. The mounting portion 2 of the arms 3 straddle the roll of toilet paper 9. A container 6 is attached to the utility portion 4 of both arms 3 in an inclined position with front side 16 lower than back side 13. Lid 7 is open providing a view of the back side 13 and bottom 14 of container 6. The utility portion 4 of the arms 3 is hidden from view.
Figure 4:
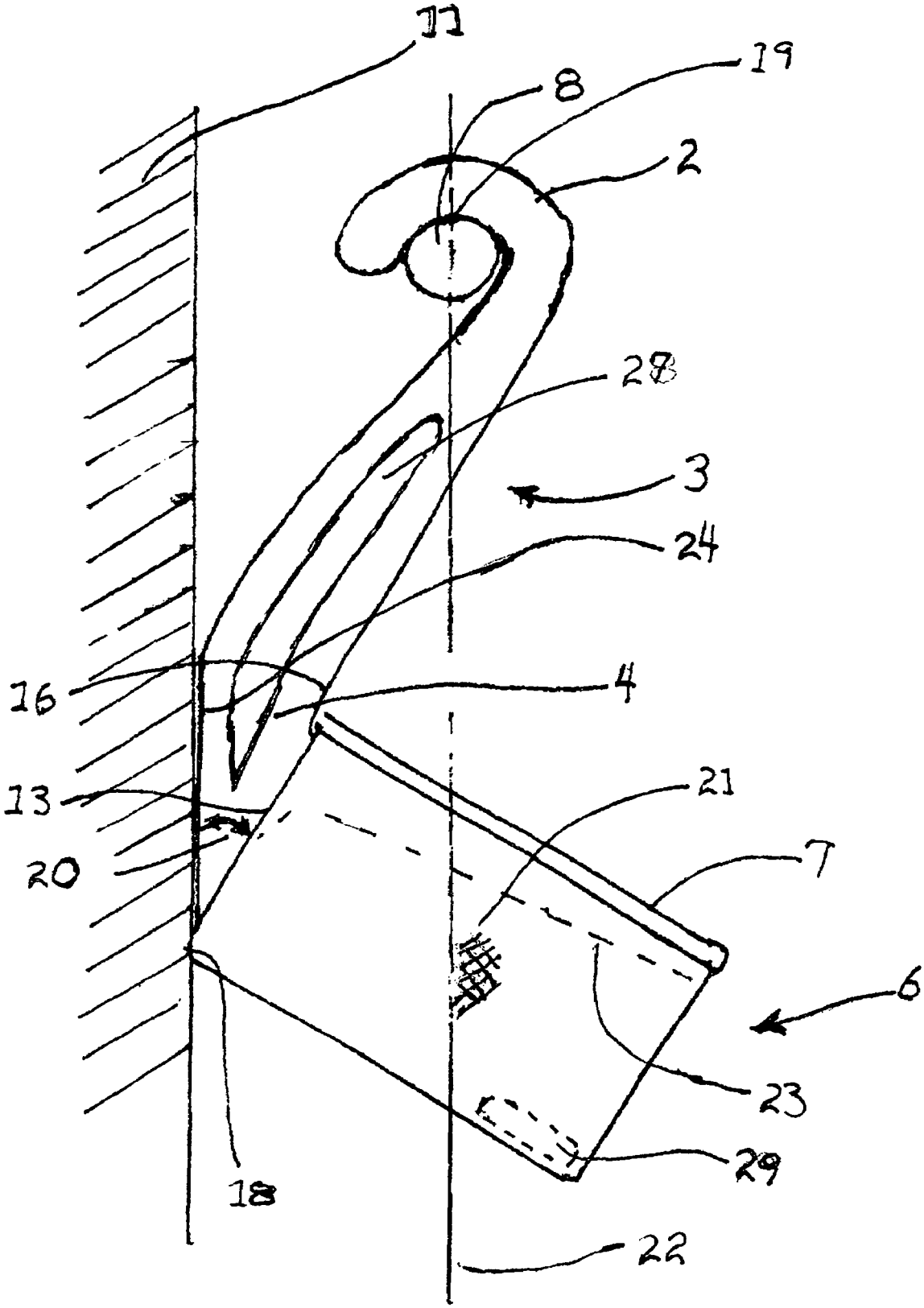
FIG. 4 is a side view of an alternative configuration of this invention attached to spindle 8 of a toilet paper holder. Arm 3 has a mounting portion 2 at the upper end and a utility portion 4 at the lower end. The mounting portion is formed as a hook rounded to securely retain spindle 8 as well as to allow the caddy to freely rest on the spindle at fulcrum 19. The forward facing surface 16 of utility portion 4 of arm 3 is attached to the back side 13 of container 6. The rear surface 24 of arm 3 and bottom edge 18 of container 6 are in contact with wall 11. A line 22 through fulcrum 19 and through the center of spindle 8 indicates the location of the center of gravity limit plane parallel to wall 8 that defines the wall-ward limit for the location of center of gravity region 21. The center of gravity region 21 encompasses the various positions the caddy center of gravity assumes depending on the content level 23 of container 6. The container inclination angle 25 is the angle between wall 11 and the back side 13 of the container. Hinged lid 7 is shown closed. To assure the center of gravity region 21 lies beyond the center of gravity limit plane 22, the portion of arm 3 on the wall side of the center of gravity limit plane is shown with a weight reducing cut-out, 27, and the portion of container 6 that extends beyond the center of gravity limit plane 22 is shown with a weight increasing means 29.
Figure 5:
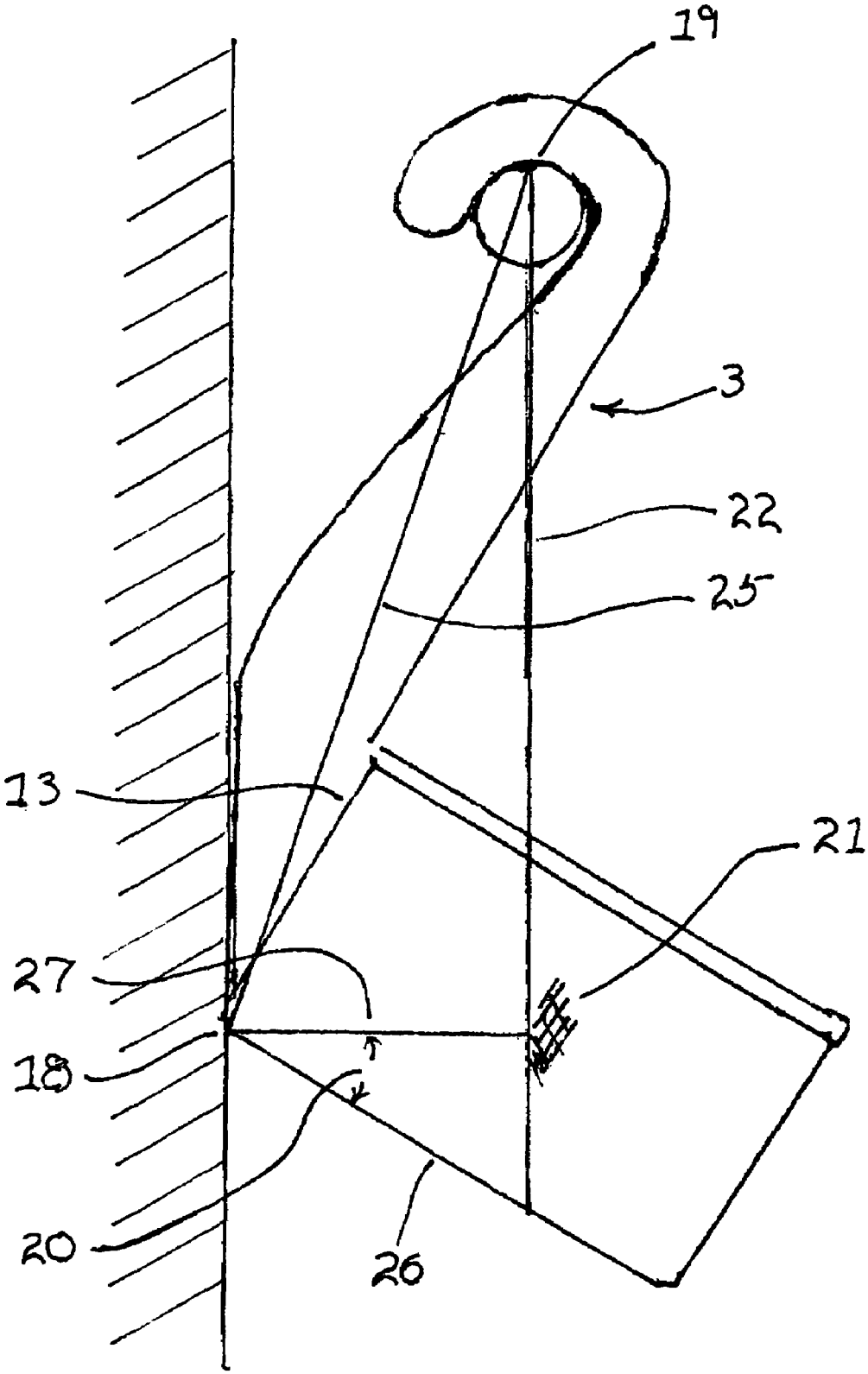
FIG. 5 is the side view of the alternative configuration illustrated in FIG. 4 showing a triangle that defines the basic structure of this invention. The triangle joins three points: 1)

the fulcrum 19, 2) the intersection of the center of gravity plane 22 and the container bottom 26, and 3) the point of contact 18 of the container bottom with wall 11. Considering the side that coincides with the center of gravity limit plane 22 to be the triangle base, the triangle height 24 is the spindle-to-wall distance. The sides and angles of this triangle mathematically determine the relationship between required location of the center of gravity region 21, container inclination angle 20, arm 3 length and spindle-to-wall distance 27.

We claim as follows:

1. A caddy, attachable to a spindle of a wall-mounted toilet paper roll holder, for storing and dispensing disposable wet wipes, and comprised of two arms, each having an upper, mounting portion and each having a lower, utility portion; each arm includes a front, room-facing, surface, and a back surface that faces the wall, and a) the mounting portion of each of said arms is configured as hooking means, attachable to said spindle on opposites sides of a roll of toilet paper, and b) said front surface of the utility portion of said arms is attached to container consisting of four sides including a front side and a back side, and two essentially horizontal surfaces namely a bottom, and a top that includes a hinged lid, and wherein said container depth as measured from front side to back side does not exceed twice the distance from said spindle to said wall, and wherein the center of gravity of the caddy varies within a region of the container as the container contents vary, and wherein the hooking means of the mounting portion of each of said arms is curved in a circular manner as to allow the caddy, when attached to the spindle, to freely seek a resting position wherein the closest point of said center of gravity region to the wall lies directly below the spindle in a vertical center of gravity plane parallel to the wall.

2. The caddy of claim 1 wherein the utility portion of said arms is attached to the back side of the container and wherein, when the container is attached to the spindle, the greatest horizontal distance from said center of gravity plane to the back surface of an arm is not less than said spindle-to-wall distance.

3. The caddy of claim 2 wherein the container, when the caddy is attached to the spindle, is inclined from front to rear and the greatest horizontal distance from the front side of said inclined container to the back side of said inclined container is not less than said spindle-to-wall distance, and the greatest horizontal distance from said center of gravity plane to the back side of said inclined container is not less than said spindle-to-wall distance.

4. The caddy of claim 1 wherein the portion of the container extending forward of the center of gravity plane when the caddy is attached to the spindle includes a weight increasing means.

5. The caddy of claim 1 wherein the portion of the arms not extending forward of said center of gravity plane when the caddy is attached to the spindle includes weight reduction means, namely cut-outs.

* * * * *